US006685659B2

(12) United States Patent
Webb

(10) Patent No.: US 6,685,659 B2
(45) Date of Patent: Feb. 3, 2004

(54) INDIVIDUAL CONTROLLED BODY MASSAGE DEVICE

(76) Inventor: Steven C. Webb, 970 SW. 3rd St., Boca Raton, FL (US) 33486

( * ) Notice: Subject to any disclaimer, the term of this patent is extended or adjusted under 35 U.S.C. 154(b) by 0 days.

(21) Appl. No.: 09/927,898

(22) Filed: Aug. 9, 2001

(65) Prior Publication Data

US 2003/0032901 A1 Feb. 13, 2003

(51) Int. Cl.[7] ..... A61H 23/00
(52) U.S. Cl. ..... 601/49; 601/46; 601/101
(58) Field of Search ..... 601/133, 46, 47, 601/51, 53, 84, 97–101, 56–58, 49

(56) References Cited

U.S. PATENT DOCUMENTS 4,016,136 A 4/1977 Anderson
4,041,938 A * 8/1977 Wintoniw ..... 601/101
4,872,422 A * 10/1989 Della Vecchia ..... 119/621
4,899,403 A * 2/1990 Yamasaki ..... 5/600
4,984,568 A 1/1991 Persaud
5,078,125 A * 1/1992 Schumacher ..... 601/101
5,083,552 A 1/1992 Lipowitz
5,456,656 A 10/1995 Skovira
6,258,047 B1 7/2001 Muramatsu
6,283,929 B1 * 9/2001 Mjehovic ..... 601/136

* cited by examiner

*Primary Examiner*—Nicholas D. Lucchesi
*Assistant Examiner*—Victor K. Hwang
(74) *Attorney, Agent, or Firm*—McHale & Slavin

(57) ABSTRACT

A massage device that allows an individual or therapist to control a massaging implement through the manipulation of control levers. The massage device employs a frame that houses the positioning motors within individual frame members to allow a simplified control scheme of vertical and horizontal movements that operate in a parallel plane to the body of an individual receiving the massage. A massaging implement pivots and rotates along a positioning arm and engages an individual by gravity. A moveable platform allows an individual to be properly positioned for the massage and permit the device to consume a small footprint during storage.

17 Claims, 5 Drawing Sheets

INDIVIDUAL CONTROLLED BODY MASSAGE DEVICE

FIELD OF THE INVENTION

This invention relates generally to massage devices and in particular to a storable massage device that allows an individual to obtain a massage while laying down or seated by manipulation of a massage head controlled by the individual receiving the massage or by a therapist providing the massage.

BACKGROUND OF THE INVENTION

The benefits of a massage is well-known, unfortunately the ability to retain a masseur when an individual would like a massage is not always practical. Further, the need to travel to a location that provides massages can be a major inconvenience especially if the massage is needed for recovery due to an injury. For these reasons there has been numerous electro/mechanical devices directed to replicating the benefits of a massage which have gained widespread use. For instance, a typical hand held massager is a device that allows an individual to obtain the benefits of a massage to any portion of the body that can be reached with the device. Unfortunately, various portions of the body cannot be easily reached necessitating the need for remotely operated back massaging devices that may be expensive or difficult to operate.

For instance, U.S. Pat. No. 4,061,136 discloses a massage apparatus for use in a bathtub. This device employs an electrical motor for the rotation of rollers and an individual sits in the bathtub to receive a massage. Beyond the basic problem of using electricity near water, the device limits how an individual is positioned within the tub thereby limiting use to those individuals agile enough to move into a particular position that requires the massage.

U.S. Pat. No. 5,083,552 discloses a computer controlled massaging unit that includes pressure sensors to determine the position of the individual for coordinating with a computer program for operating of the massage unit. An edge detector sensor is employed for detecting the perimeter of the individual's body which allows movement along the individuals perimeter. A unique track system is also claimed for operating the massage unit along a predetermined plane.

U.S. Pat. No. 5,456,656 discloses a back massaging device wherein the massaging implement is moved along a frame by stepper motors. The device employs a sensor or pressure transducer positioned between an applicator and a frame in order to sense the amount of force applied by an individual's body. This invention relies upon the sensor device in order to sense the amount of force applied to the body portion and provide a control signal according to the sensed force. Upon receipt of the control signal, the massage unit controller is moved accordingly.

U.S. Pat. No. 4,984,568 discloses a back massaging device that allows for attachment to the side of a bed or the like rigid frame. A massage head is placed along the distal end of a control arm and manipulated by use of a hydraulic cylinder controlled by a hand operated joystick. This device is held in a fixed position wherein any rotational aspects must be manipulated by the hydraulic ram. The disclosure and claims further rely upon a lotion applicator that is used in conjunction with the programmable massaging implement. It is noted that pressure on the massage applicator is directly from the hydraulic positioning unit with no accommodations made for movement by the individual. The massage implement is based upon a singular support structure wherein movement of the massage implement along the torso of an individual requires movement of the hydraulic ram. However, movement from the pivot point defeats the ability to make a smooth massage and results in continuous control operation as the device is operating as a robotic arm.

U.S. Pat. No. 6,258,047 discloses a therapeutic pressing device which operates parallel to the back of an individuals spine for purposes of applying pressure to the spine for detecting spinous process.

Thus, what is lacking in the art is a low cost, storable massage device that can used by an untrained individual for purposes of obtaining a self massage.

SUMMARY OF THE INVENTION

The present invention is a massage device that allows an individual to control a massaging implement through the manipulation of control levers. The massage device employs a frame that houses the positioning motors within individual frame members to allow a simplified control scheme of vertical and horizontal movements. A massaging implement pivots both vertically and horizontally along a positioning arm and engages an individual's torso by gravity. The articulating massage implement allows for curvatures to be followed and massaged at various angles. A platform allows an individual to be properly positioned for the massage and can be placed into a storage position allowing the device to consume a very small footprint. Alternatively, the device may be placed upright allowing an individual to receive a massage while seated.

The massaging device employs two vertical support structures having at least one vertical trolley for movement of a positioning arm support bracket and boom support placed between the support structures. The positioning arm also includes a trolley assembly that controls the horizontal placement of a gravity held massaging implement. An individual may control each of the positioning motors for precise placement of the massaging implement.

An objective of the invention is to disclose a low cost, storable massage device that can be precisely controlled by the individual receiving the massage or by a therapist providing the massage.

Another objective of the invention is to disclose the use of a gravity weighted massage implement providing a range of movement by the individual without affecting implement pressure.

Another objective of the invention is to disclose vertical and horizontal positioning controls for parallel body movement to allow an individual instant recognition of operational control.

Still another objective of the invention is to disclose a massage device that allows a therapist to control a massage without physically performing the massage.

Yet another objective of the invention is to disclose a frame that permits a positioning platform to be folded into a storage position providing the massaging device to consume a small footprint while stored.

Another objective of the invention is to disclose the use of a frame that also houses the positioning motors providing quiet operation, reduced mass, and protection from moving parts.

Still another objective of the invention is to disclose a storable back massage device that can be used by an individual in a seated or laying position.

Another objective of the invention is to disclose a storable back massage device that includes a means for parking the massage implement after use allowing for ease of access in entering or leaving the platform.

Yet still another objective of the invention is to disclose the use of common trolley motor/screw combinations which could provide commonality in parts for ease of repair and low cost of manufacture.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION

Although the invention will be described in terms of a specific embodiment, it will be readily apparent to those skilled in this art that various modifications, rearrangements and substitutions can be made without departing from the spirit of the invention. The scope of the invention is defined by the claims appended hereto.

Figure 1:
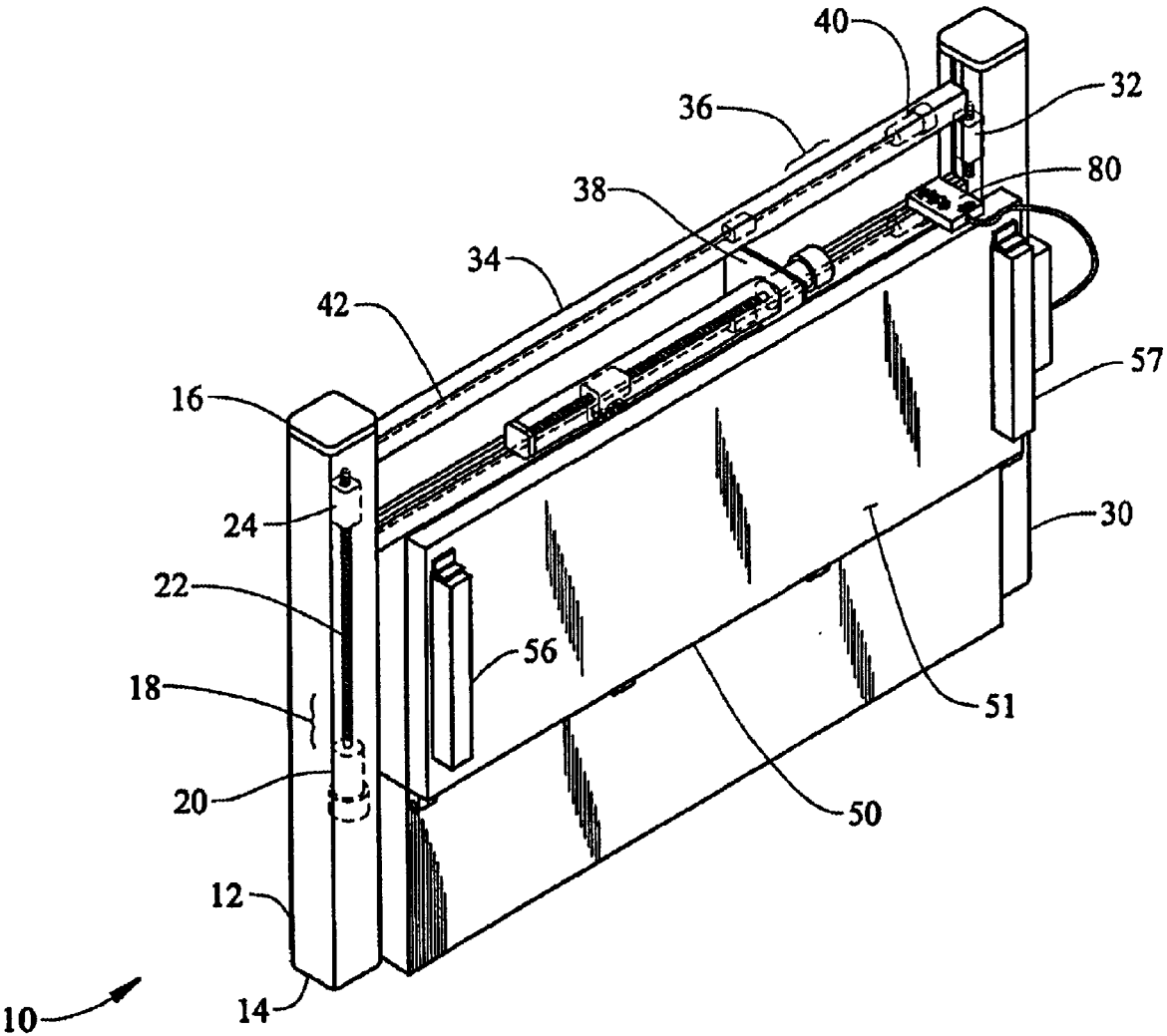
FIG. 1 is a perspective view of the massage unit of the instant invention in a stored position.
Figure 2:
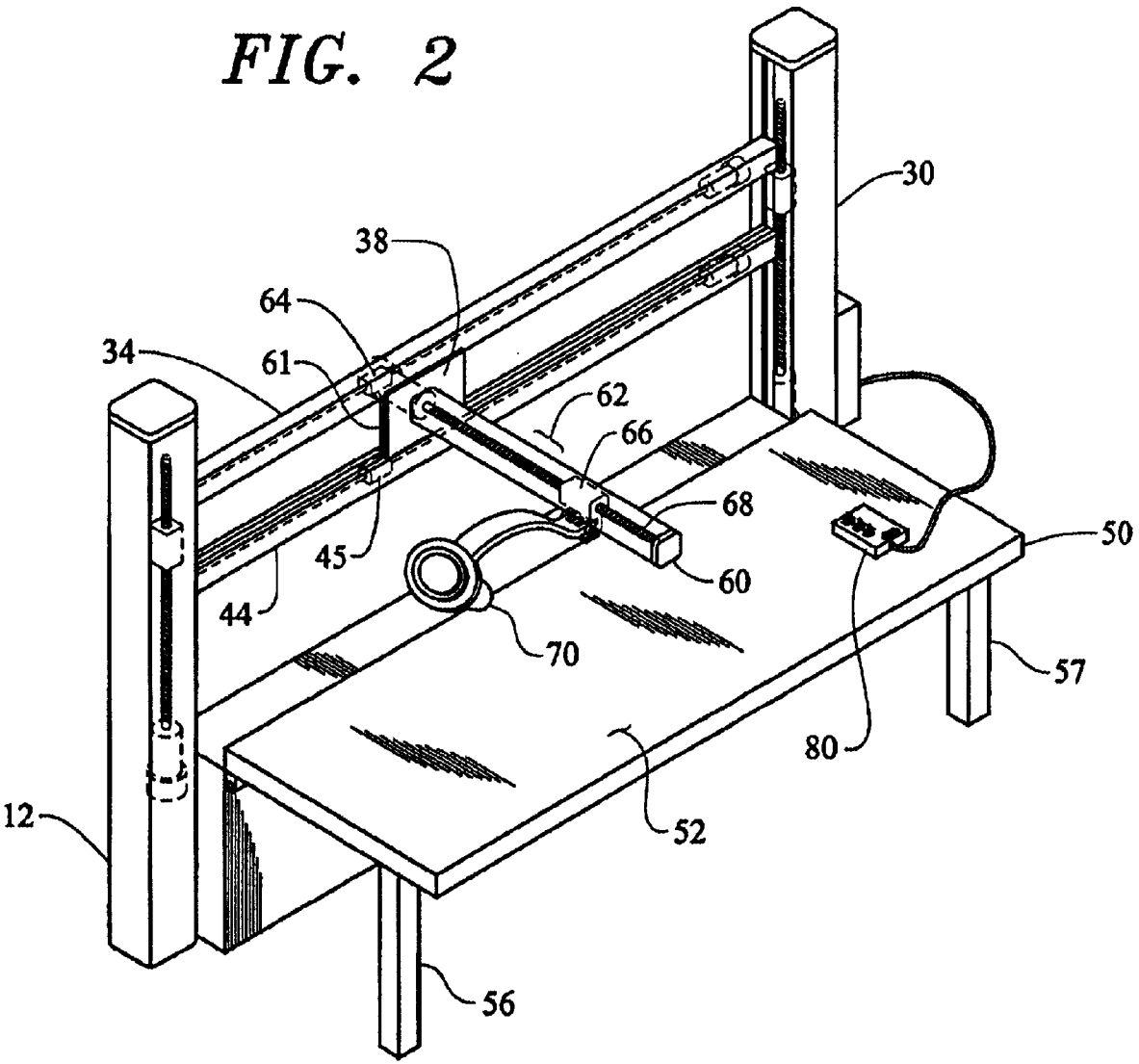
FIG. 2 is a perspective view of the massage unit in an operating position.

Referring now to FIGS. 1 and 2, the storable body massage device 10 of the instant invention is depicted in both a storage position and an operating position. The massage device has a frame formed from a first vertically disposed support structure having a base 14 and a top 16 with a first vertical trolley assembly 18 placed therebetween. For purposes of example, the trolley 18 used herein may employ a parallel shaft AC gear motor 20 such as that manufactured by LEESON M1125132. The trolley 18 includes a lead screw 22 directly coupled to the motor 20 for use in the vertical movement of a first positioning arm support bracket 24 between the bottom base 14 and the top 16. The reverse motor 20 allows the lead screw 22 to be rotated in either direction. Alternatively, a scissors style trolley assembly can be employed.

A second support structure 30 is vertically disposed in a parallel plane to the first support structure 12. The second support member 30 may operate as an idler having a second support bracket 32 for tracking of the positioning arm support bracket 24 or include a second trolley assembly providing direct cooperating support of the positioning arm 34.

The positioning arm 34 is securable to the first 24 and second 32 positioning arm support brackets. The positioning arm 34 includes a first horizontal trolley assembly 36 for moving a boom mount support bracket 38 between the first support bracket 12 and second support bracket 30. The trolley 36 used herein is similar to the first vertical trolley employing an AC gear motor 40 with a lead screw 42 directly coupled to the motor 40 for use in the horizontal movement of the boom mount support bracket 38. It should be noted and understood that the electric motor 40 can be substituted for a hydraulic motor, not shown, employing the same concept of support bracket movement. Further, a scissors style assembly, not shown, can be employed for movement of the support brackets. A lower positioning arm 44 may be used in a parallel plane to the positioning arm 34 and operate as an idler, having a second support bracket 45 for tracking of the boom mount support bracket 38, or include a second trolley assembly providing direct cooperating support of the boom mount support bracket 38.

A body supporting member 50 is hingedly coupled to the first support structure 12 and second 30 support structure. The body supporting member 50 is defined by an upper surface 52 and a lower surface 54 that is movable from a vertical position for storage as shown in FIG. 1 to a horizontal position for support of a body as shown in FIG. 2. The lower surface 54 has support legs 56 and 57 hingedly coupled thereto for support of the body supporting member 50 when placed into a horizontal position.

Figure 3:
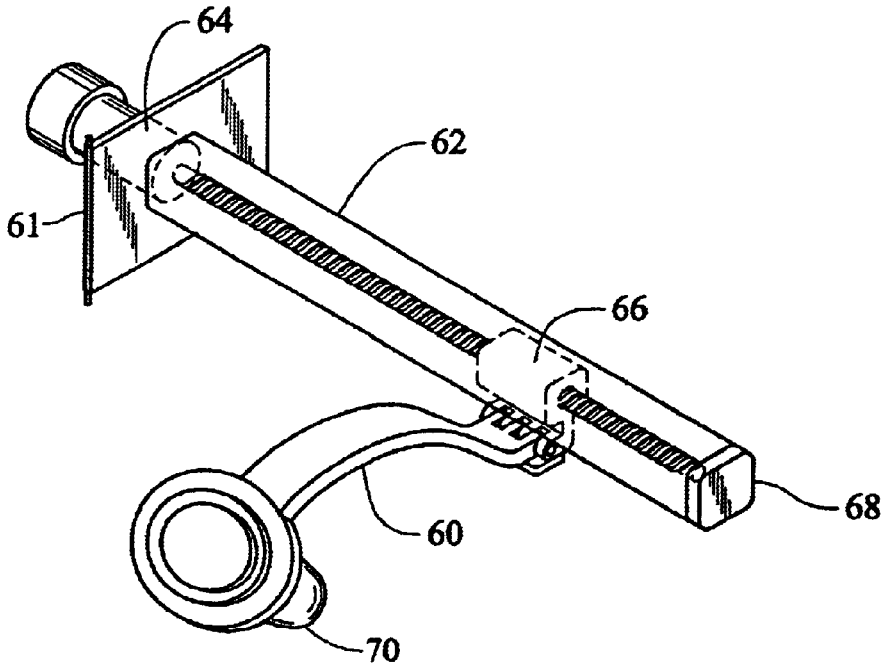
FIG. 3 is a plane view of the boom arm depicting a trolley motor and positioning screw.
Figure 4:
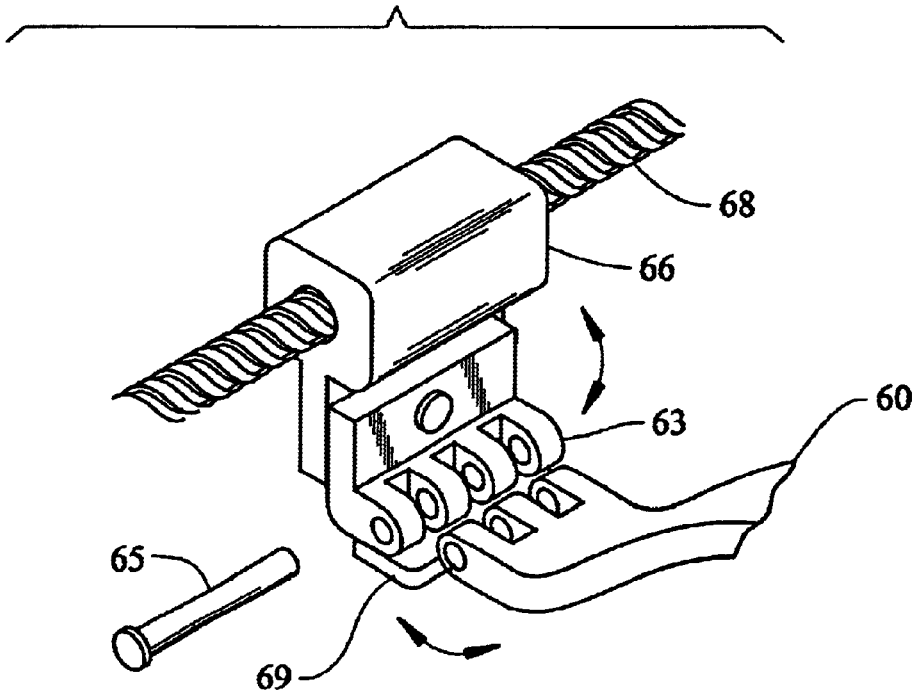
FIG. 4 is a perspective view of the massage unit in a vertical position.

Referring to FIGS. 2 and 3, the boom arm 60 and the boom mount support bracket 38 are hingedly coupled 61 to the positioning arms 34 and 44 and employs a second horizontal trolley assembly 62 comprising an electric motor 64 and lead screw 68 for use in moving a massage head support bracket 66 along a horizontal plane over the body supporting member 50. The massaging implement 70 is designed to provide a comfortable massage that duplicates a therapist massage, such as that provided by a Brookstone 15 speed percussion massage unit that is hingedly secured to the support bracket 66. The massage implement provides a vibrating head found beneficial for hand held massage devices. The boom arm 60 relies upon gravity to support the massage implement 70 with an example embodiment depicted wherein the boom arm 60 includes a hinge coupling 63 providing both horizontal and vertical movement and held together by a hinge pin 65. The hinge coupling 63 includes a boom arm stop 69 to prevent the boom arm from over extending the horizontal position. Each trolley unit is placed in a tube shaped housing having a motor support bracket located along one end with a lead screw coupled thereto. A lead screw has a bearing support bracket along the opposite end wherein one of the support brackets engages the lead screw and is accessible along one side of the tube shaped housing. Each support bracket is moveable along the length of the housing during rotation of the lead screw. As previously mentioned, a scissor jack may be substituted for the lead screw arrangement.

Figure 6:
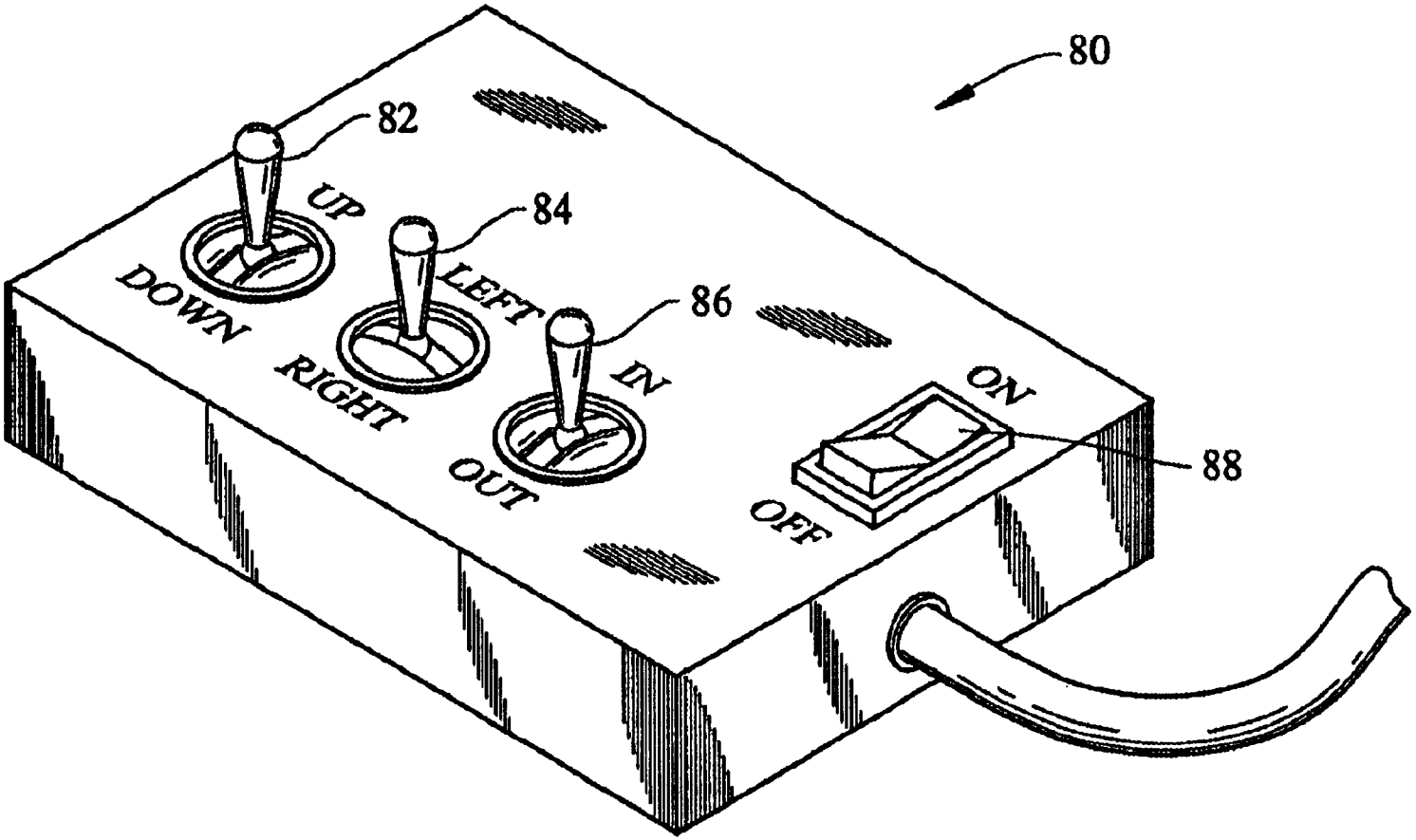
FIG. 6 is a plane view illustrating one embodiment of the controller.

FIG. 6 depicts the controller 80 which is electrically coupled to the trolleys allowing an individual laying on the body supporting member 50 to actuate each trolley allowing traverse positioning of the massaging implement 70 over the individuals body for self controlled massage. The positioning actuator can be a joystick such as that depicted or a trackball. The preferred controller 80 has a simplified control system having a first joystick 82 for controlling the vertical movement of the massage implement. A second joystick 84 for controlling the horizontal movement of the massage implement, that is the movement between the head and the lower torso of an individual laying on the platform. A third joystick 86 moves the massage implement along the length of the boom arm 60, that is the movement across the width of the individuals body. An on/off switch 88 provides operation of the massage implement and may also be used as a master control switch for each of the track assemblies.

More extensive controllers include mapping of the torso for repeatable massages or use of less joystick controller by incorporating multiple functions into a single actuating device. In addition, the controller may be programmed to "park" the massage implement when the off switch 88 is actuated. In this manner, the implement is moved up and away from the body to a position that allows ease of access for the individual laying on the platform.

Figure 5:
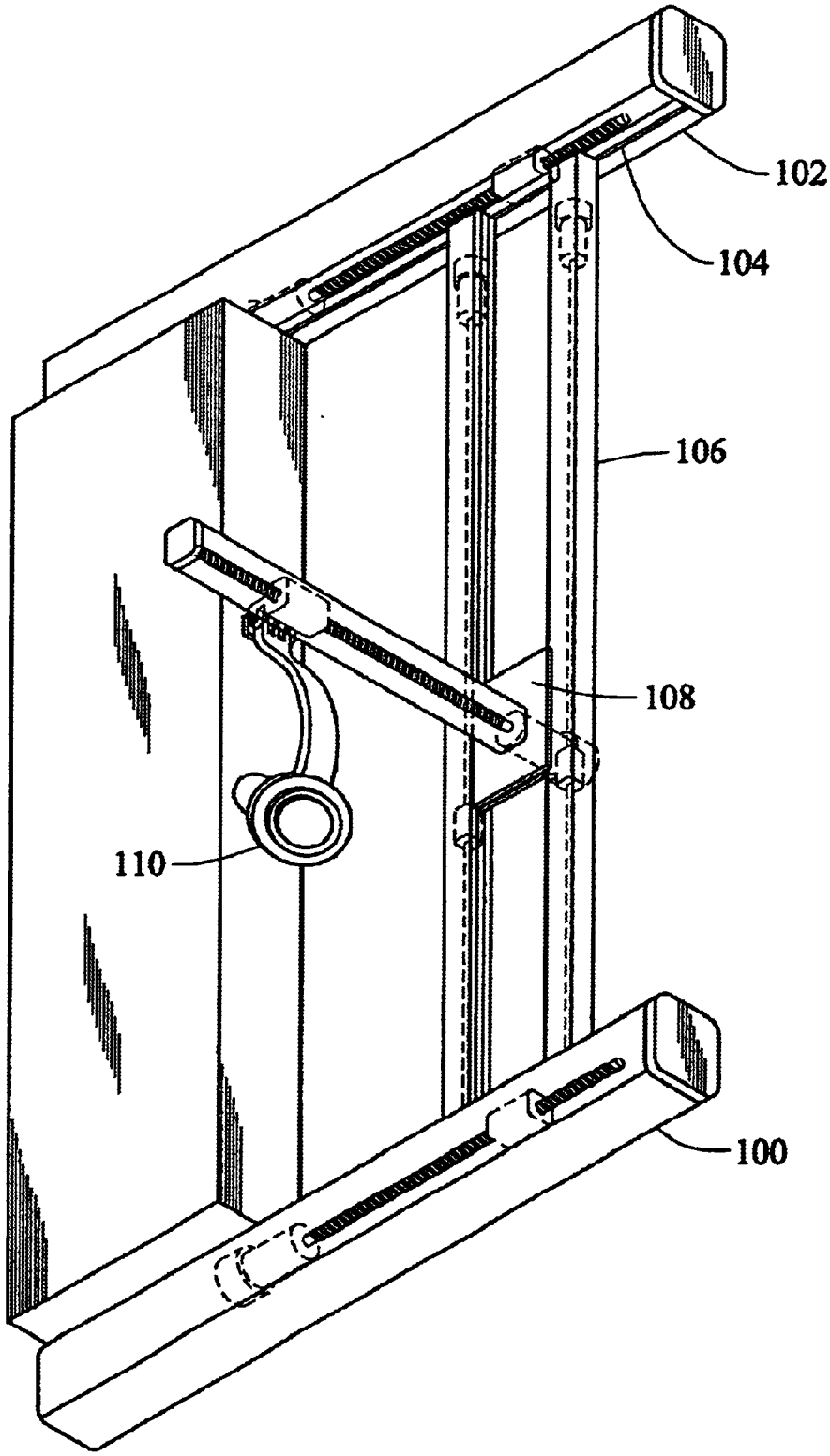
FIG. 5 is a perspective view of an alternative embodiment of the instant invention placed in an upright position.

FIG. 5 illustrates an alternative embodiment wherein the massage device can be used in a vertical format allowing an individual to obtain a massage while in a seated position. In this embodiment, the platform is removed and the device placed into an upright vertical position. The previously defined vertical support structures 100 and 102 are now in a horizontal position. However, the trolley assembly 104 operates in the same manner only to move the upright support 106 in a horizontal plane. The upright support 106 is then used to move the boom support bracket 108 in a vertical relationship. The boom support 108 includes a trolley assembly for moving a massage implement 110 in an outward manner allowing a seated individual, not shown, to obtain a massage as set forth in the first embodiment. The operation of the trolleys and controller are similar to the first embodiment as if restated in its entirety.

It is to be understood that while I have illustrated and described certain forms of my invention, it is not to be limited to the specific forms or arrangement of parts herein described and shown. It will be apparent to those skilled in the art that various changes may be made without departing from the scope of the invention and the invention is not to be considered limited to what is shown in the drawings and described in the specification.

What I claim is:

1. A body massage device comprising:

a first vertical support structure having a base and a top with a vertical trolley means for moving a first positioning arm support bracket between said bottom base and said top;

a second vertical support structure having a base and a top placed in parallel plane to said first vertical support structure;

a first positioning arm support bracket and a second positioning arm support bracket attached to said first and second vertical support structure, respectively;

a positioning arm securable to said first and second positioning arm support brackets, said positioning arm including a first horizontal trolley means for moving a hingedly coupled boom mount support bracket between said first and second vertical support structures;

a body supporting member positioned between said first and second support structure;

a boom arm coupled to said boom mount support bracket having a second horizontal trolley means for moving a massage head support bracket along a horizontal plane over said body supporting member;

a massaging implement hingedly secured to said second horizontal trolley means; and a controller allowing an individual laying on said body supporting member to actuate each said trolley means allowing traverse positioning of said massaging implement over the individual's body for self controlled massage.

2. The device according to claim 1 wherein said controller is a joystick coupled to said trolley means for positioning of said massaging implement.

3. The device according to claim 1 wherein each said trolley means includes a tube shaped housing including a support bracket accessible along at least one side of said housing and moveable along the length of the housing during operation of the trolley motor.

4. The device of claim 3 wherein each said trolley means includes a threaded rod and each threaded rod is coupled to and made rotatable by a reversible electric motor.

5. The device according to claim 1 including at least one support leg secured to the lower surface of said body supporting member for support of said body supporting member when placed into a horizontal position.

6. A storable body massage device comprising:

a frame formed from a first support structure vertically disposed and having a base and a top with a first vertical trolley means placed therebetween for moving a first positioning arm support bracket between said base and said top; a second support structure vertically disposed and placed in the vertical plane of said first support structure in a cooperating manner to said first support structure; a positioning arm securable to said first and second positioning arm support brackets, said positioning arm including a first horizontal trolley means for moving a hingedly coupled boom mount support bracket between said first and second support brackets; and a body supporting member hingedly coupled to said first and second support structure, said body supporting member having an upper surface and a lower surface that is movable from a vertical position for storage to a horizontal position for support of a body, said lower surface having at least one support leg secured thereto for support of said body supporting member when placed into a horizontal position;

a boom arm coupled to said boom mount support bracket having a second horizontal trolley means for moving a massage head support bracket along a horizontal plane over said body supporting member;

a massaging implement hingedly secured to said second horizontal trolley means; and a controller having at least one electrically coupled positioning actuator allowing an individual laying on said body supporting member to actuate each said trolley means allowing traverse positioning of said massaging implement over the individuals body for self controlled massage.

7. The device according to claim 6 wherein said positioning actuator is a joystick.

8. The device according to claim 6 wherein each said trolley means includes a tube shaped housing including a support bracket accessible along at least one side of said housing and moveable along the length of the housing during operation of the trolley motor.

9. The device of claim 8 wherein each said trolley means includes a threaded rod and each threaded rod is coupled to and made rotatable by a reversible electric motor.

10. The device according to claim 9 wherein said second support structure includes a second vertical trolley means placed therebetween for moving said second positioning arm support bracket between said bottom base and said top in a cooperating manner to said first support structure.

11. The device according to claim 6 wherein said controller includes a parking means for positioning of said implement.

12. A body massage device comprising:

a first support structure vertically disposed having a base and a top with a first vertical trolley means placed therebetween for moving a first positioning arm support bracket between said bottom base and said top; a second support structure vertically disposed having a base and a top with a second vertical trolley means placed therebetween for moving a second positioning arm support bracket between said bottom base and said top in a cooperating manner to said first support structure; a positioning arm securable to said first and second positioning arm support brackets, said positioning arm including a first horizontal trolley means for moving a hingedly coupled boom mount support bracket between said first and second support brackets;

a boom arm coupled to said boom mount support bracket having a second horizontal trolley means for moving a massage head support bracket along a horizontal plane;

a massaging implement hingedly secured to said second horizontal trolley means; and a controller allowing an individual laying on said body supporting member to actuate each said trolley means allowing traverse positioning of said massaging implement for a self controlled massage.

13. The device according to claim 12 wherein said controller is further defined as a control box having at least one electrically coupled positioning actuator.

14. The device according to claim 12 wherein said controller is a joystick electrically coupled to said trolley means for positioning of said massaging implement.

15. The device according to claim 12 wherein each said trolley means includes a tube shaped housing having a threaded rod rotatably secured therein, said housing including a support bracket engaging said rod and accessible along at least one side of said housing, said support bracket moveable along the length of the housing during rotation of said threaded rod.

16. The device of claim 15 wherein each said trolley means includes a threaded rod and each threaded rod is coupled to and made rotatable by a reversible electric motor.

17. The device according to claim 12 including at least one support leg secured to the lower surface of said body supporting member for support of said body supporting member when placed into a horizontal position.

* * * * *